US006872085B1

(12) United States Patent
Cohen et al.

(10) Patent No.: US 6,872,085 B1
(45) Date of Patent: Mar. 29, 2005

(54) HIGH SPEED, HIGH DENSITY ELECTRICAL CONNECTOR ASSEMBLY

(75) Inventors: Thomas S. Cohen, New Boston, NH (US); Marc B. Cartier, Dover, NH (US); John R. Dunham, Nashua, NH (US); Jason J. Payne, Nashua, NH (US)

(73) Assignee: Teradyne, Inc., Boston, MA (US)

( * ) Notice: Subject to any disclaimer, the term of this patent is extended or adjusted under 35 U.S.C. 154(b) by 0 days.

(21) Appl. No.: 10/675,087

(22) Filed: Sep. 30, 2003

(51) Int. Cl.[7] ..... H01R 4/66
(52) U.S. Cl. ..... 439/108; 439/608; 439/947
(58) Field of Search ..... 439/608–610, 439/108, 101, 74, 75

(56) References Cited

U.S. PATENT DOCUMENTS 4,846,727 A * 7/1989 Glover et al. ..... 439/608
5,104,341 A * 4/1992 Gilissen et al. ..... 439/608
5,139,426 A * 8/1992 Barkus et al. ..... 439/65
5,286,212 A * 2/1994 Broeksteeg ..... 439/108
5,429,521 A * 7/1995 Morlion et al. ..... 439/108
5,500,788 A * 3/1996 Longueville et al. ..... 361/800
5,795,191 A * 8/1998 Preputnick et al. ..... 439/608
5,860,816 A * 1/1999 Provencher et al. ..... 439/79
5,865,645 A * 2/1999 Embo et al. ..... 439/567
5,967,846 A * 10/1999 Davis et al. ..... 439/609
6,146,157 A * 11/2000 Lenoir et al. ..... 439/101
6,179,663 B1 * 1/2001 Bradley et al. ..... 439/608
6,220,896 B1 * 4/2001 Bertoncini et al. ..... 439/608
6,299,484 B2 * 10/2001 Van Woensel ..... 439/608
6,371,813 B2 * 4/2002 Ramey et al. ..... 439/608
6,375,508 B1 * 4/2002 Pickles et al. ..... 439/608
6,409,543 B1 6/2002 Astbury, Jr. et al. ..... 439/608
6,431,886 B1 * 8/2002 Ramey et al. ..... 439/101
6,435,913 B1 * 8/2002 Billman ..... 439/608
6,461,202 B2 * 10/2002 Kline ..... 439/701
6,468,109 B1 * 10/2002 Wu ..... 439/567
6,506,076 B2 1/2003 Cohen et al. ..... 439/608
6,540,522 B2 * 4/2003 Sipe ..... 439/61
6,551,140 B2 * 4/2003 Billman et al. ..... 439/608
6,572,410 B1 * 6/2003 Volstorf et al. ..... 439/608
6,641,438 B1 * 11/2003 Billman ..... 439/608

* cited by examiner

*Primary Examiner*—Tho D. Ta
*Assistant Examiner*—Larisa Tsukerman
(74) *Attorney, Agent, or Firm*—David H. Hwang; Teradyne Legal Department

(57) ABSTRACT

There is disclosed an electrical connector assembly having a first electrical connector mateable to a second electrical connector. In one embodiment, the first electrical connector includes a plurality of wafers, with each wafer having an insulative housing, a plurality of signal conductors and a shield plate. A portion of the shield plate is exposed so that a conductive member can electrically connect the shield plates of the wafers at the exposed portion of the shield plate. In one embodiment, the second electrical connector includes an insulative housing, and a plurality of signal conductors and ground conductors in a plurality of rows. Each row corresponds to a wafer of the first electrical connector. Each signal conductor has a contact tail and each ground conductors has two contact tails. The signal conductors and the ground conductors are positioned adjacent to one another so that for each signal conductor contact tail, there are ground conductor contact tails adjacent either side of the signal conductor contact tail.

7 Claims, 11 Drawing Sheets

HIGH SPEED, HIGH DENSITY ELECTRICAL CONNECTOR ASSEMBLY

BACKGROUND OF THE INVENTION

This invention relates generally to an electrical connector assembly for interconnecting printed circuit boards. More specifically, this invention relates to a high speed, high density electrical connector and connector assembly.

Electrical connectors are used in many electronic systems. It is generally easier and more cost effective to manufacture a system on several printed circuit boards ("PCBs") which are then connected to one another by electrical connectors. A traditional arrangement for connecting several PCBs is to have one PCB serve as a backplane. Other PCBs, which are called daughter boards or daughter cards, are then connected through the backplane by electrical connectors.

Electronic systems have generally become smaller, faster and functionally more complex. This typically means that the number of circuits in a given area of an electronic system, along with the frequencies at which the circuits operate, have increased significantly in recent years. The systems handle more data and require electrical connectors that are electrically capable of handling the increased bandwidth.

As signal frequencies increase, there is a greater possibility of electrical noise being generated in the connector in forms such as reflections, cross-talk and electromagnetic radiation. Therefore, the electrical connectors are designed to control cross-talk between different signal paths, and to control the characteristic impedance of each signal path. The characteristic impedance of a signal path is generally determined by the distance between the signal conductor for this path and associated ground conductors, as well as both the cross-sectional dimensions of the signal conductor and the effective dielectric constant of the insulating materials located between these signal and ground conductors.

Cross-talk between distinct signal paths can be controlled by arranging the various signal paths so that they are spaced further from each other and nearer to a shield plate, which is generally the ground plate. Thus, the different signal paths tend to electromagnetically couple more to the ground conductor path, and less with each other. For a given level of cross-talk, the signal paths can be placed closer together when sufficient electromagnetic coupling to the ground conductors are maintained.

Electrical connectors can be designed for single-ended signals as well as for differential signals. A single-ended signal is carried on a single signal conducting path, with the voltage relative to a common ground reference set of conductors being the signal. For this reason, single-ended signal paths are very sensitive to noise present on the common reference conductors. It has thus been recognized that this presents a significant limitation on single-ended signal use for systems with growing numbers of higher frequency signal paths.

Differential signals are signals represented by a pair of conducting paths, called a "differential pair." The voltage difference between the conductive paths represents the signal. In general, the two conducing paths of a differential pair are arranged to run near each other. If any other source of electrical noise is electromagnetically coupled to the differential pair, the effect on each conducting path of the pair should be similar. Because the signal on the differential pair is treated as the difference between the voltages on the two conducting paths, a common noise voltage that is coupled to both conducting paths in the differential pair does not affect the signal. This renders a differential pair less sensitive to cross-talk noise, as compared with a single-ended signal path. One example of a differential pair electrical connector is the GbX™ connector manufactured and sold by the assignee of the present application.

While presently available differential pair electrical connector designs provide generally satisfactory performance, the inventors of the present invention have noted that at high speeds, the available electrical connector designs may not sufficiently provide desired minimal cross-talk, impedance and attenuation mismatch characteristics. And the signal transmission characteristics degrade.

These problems are more significant when the electrical connector utilizes single-ended signals, rather than differential signals.

What is desired, therefore, is a high speed, high density electrical connector and connector assembly design that better addresses these problems.

SUMMARY OF THE INVENTION

There is disclosed an electrical connector assembly having a first electrical connector mateable to a second electrical connector. In one embodiment, the first electrical connector includes a plurality of wafers, with each wafer having an insulative housing, a plurality of signal conductors and a shield plate. A portion of the shield plate is exposed so that a conductive member can electrically connect the shield plates of the wafers at the exposed portion of the shield plate. In one embodiment, the second electrical connector includes an insulative housing, and a plurality of signal conductors and ground conductors in a plurality of rows. Each row corresponds to a wafer of the first electrical connector. Each signal conductor has a contact tail and each ground conductors has two contact tails. The signal conductors and the ground conductors are positioned adjacent to one another so that for each signal conductor contact tail, there are ground conductor contact tails adjacent either side of the signal conductor contact tail.

BRIEF DESCRIPTION OF THE DRAWING

The foregoing features of this invention, as well as the invention itself, may be more fully understood from the following description of the drawings in which.

DETAILED DESCRIPTION OF THE INVENTION

Figure 1:
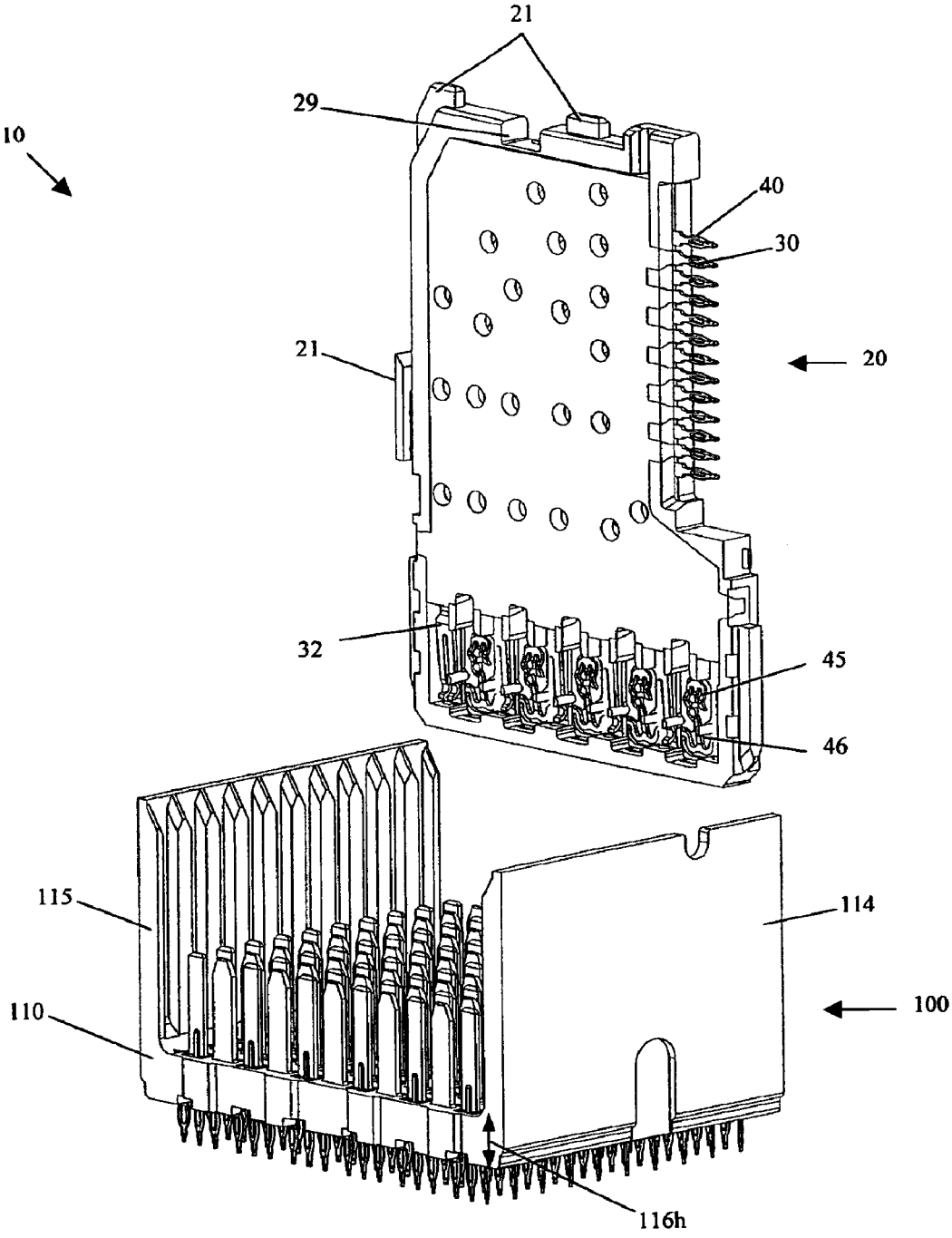
FIG. 1 is a perspective view of an embodiment of the electrical connector assembly of the present invention showing one of the wafers of a first electrical connector about to mate with a second electrical connector.

Referring to FIG. 1, there is shown an electrical connector assembly in accordance with an embodiment of the present invention. The electrical connector assembly 10 includes a first electrical connector mateable to a second electrical connector 100. The first electrical connector includes a plurality of wafers 20, only one of which is shown in FIG. 1, with the plurality of wafers 20 preferably held together by a stiffener (such as a stiffener 210 illustrated in FIG. 10). Note that each of the wafers 20 is provided with an attachment feature 21 for engaging the stiffener. For exemplary purposes only, the first electrical connector has ten wafers 20, with each wafer 20 having six single-ended signal conductors 24 and a corresponding shield plate 26 (see FIG. 2). However, as it will become apparent later, the number of wafers, the number of signal conductors and the number of shield plates may be varied as desired.

Figure 2:
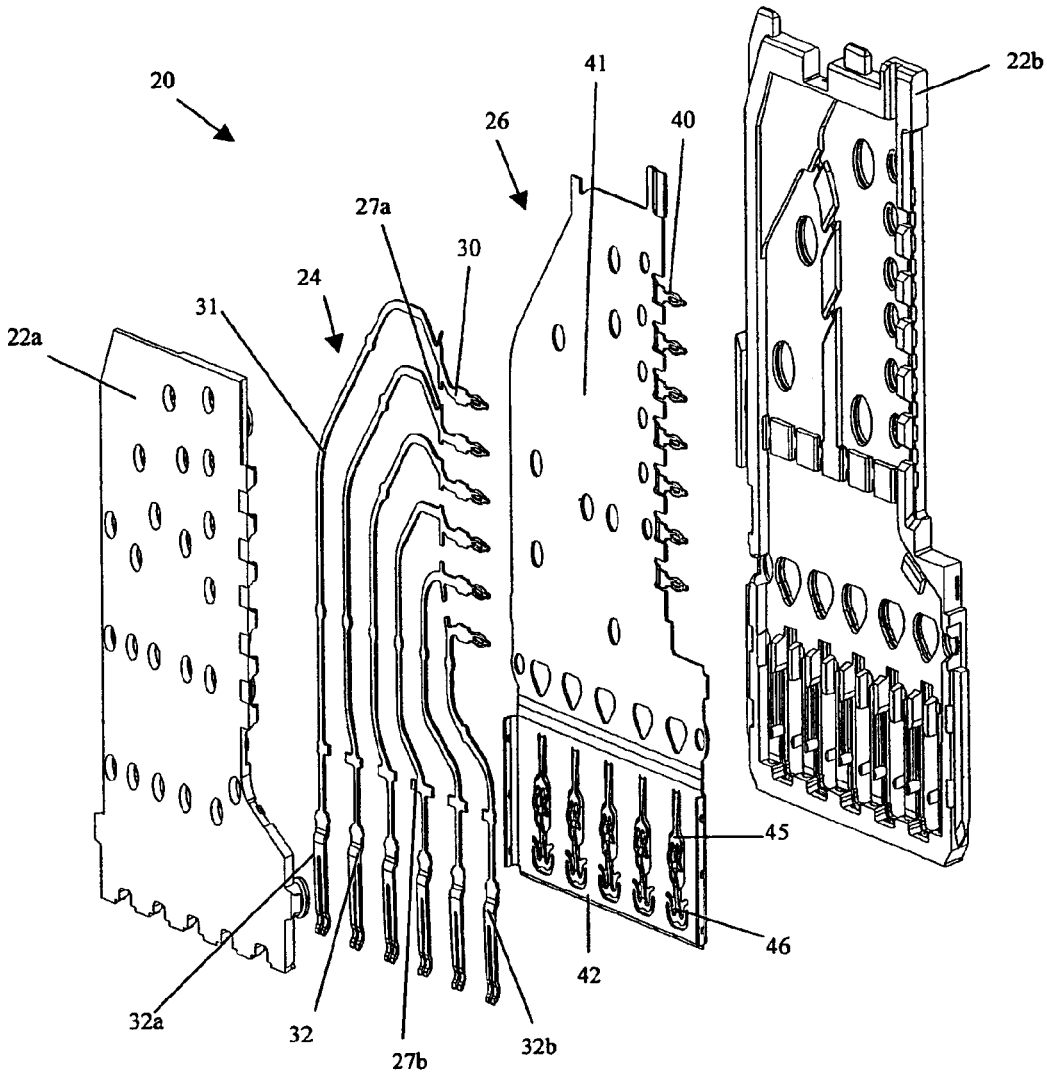
FIG. 2 is an exploded view of the wafer of the first electrical connector of FIG. 1.

FIG. 2 is an exploded view of the wafer 20 of FIG. 1. The wafer 20 includes an insulative housing, having first and second housing portions 22*a*, 22*b*, formed around the signal conductors 24 and the shield plate 26 by a molding process. The signal conductors 24, which are preferably held together on a lead frame (only cut-off tie bars 27*a*, 27*b* of the lead frame are shown in FIG. 2 for exemplary purposes), are preferably disposed in the second housing portion 22*b* over the shield plate 26. The signal conductors 24, for example, may be pressed into channels (not indicated with reference numerals) provided in the second housing portion 22*b*. The first housing portion 22*a* is then preferably molded over the assembly to form the wafer 20. The wafer assembly process may utilize relevant process steps as described in U.S. Pat. No. 6,409,543, which is assigned to the assignee of the present application.

Each signal conductor 24 has a first contact end 30 connectable to a printed circuit board (not shown), a second contact end 32 connectable to the second electrical connector 100, and an intermediate portion 31 therebetween. Each shield plate 26 has a first contact end 40 connectable to the printed circuit board, a second contact end 42 connectable to the second electrical connector 100, and an intermediate plate portion 41 therebetween. The shield plate 26 is shown in greater detail in FIG. 3.

In the embodiment of the wafer 20 shown, the first contact end 30 of the signal conductors 24 is a press-fit contact tail. The second contact end 32 of the signal conductors 24 is preferably a dual beam structure configured to mate to a corresponding mating structure of the second electrical connector 100, to be described below. The first contact end 40 of the shield plate 26 includes press-fit contact tails similar to the press-fit contact tails of the signal conductors 24. The second contact end 42 of the shield plate 26 includes opposing contacting members 45, 46 that are configured to provide a predetermined amount of flexibility when mating to a corresponding structure of the second electrical connector 100. While the drawings show contact tails adapted for press-fit, it should be apparent to one of ordinary skill in the art that the first contact end 30 of the signal conductors 24 and the first contact end 40 of the shield plate 26 may take any known form (e.g., pressure-mount contact tail, paste-in-hole solder attachment, contact pad adapted for soldering) for connecting to a printed circuit board.

Figure 3:
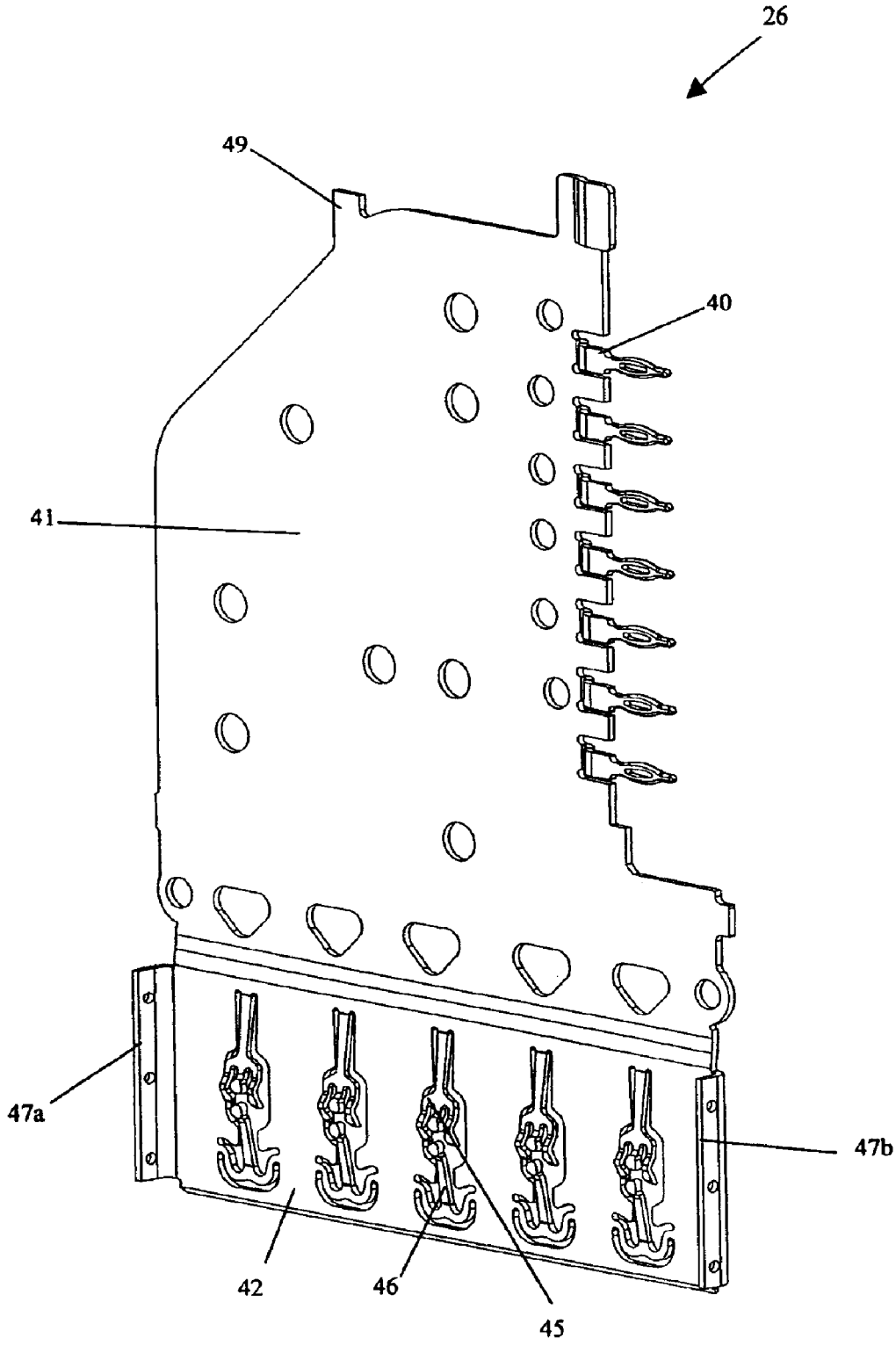
FIG. 3 is a perspective view of a shield plate of the wafer of FIG. 2.

Referring to FIG. 3, the second contact end 42 of the shield plate 26 has a first edge 47*a* and a second edge 47*b*, both of which are preferably bent in the direction of the adjacent signal conductors 24 of the wafer 20. And the bent first and second edges 47*a*, 47*b* are positioned outside the outermost signal second contact ends 32*a*, 32*b*, to respectively, in the assembled wafer 20 (see FIG. 2). By this design, each of the second contact ends 32 of the signal conductors 24 will have, on either side, a shield element (either a bent edge 47*a*, 47*b* or opposing contacting members 45, 46 of the shield plate 26) to provide desirable shielding for the signal conductors 24 (thus, providing improved signal electrical characteristics). Note that by utilizing bent edges 47*a*, 47*b*, rather than opposing contacting members 45, 46, to shield the outermost signal second contact ends 32*a*, 32*b*, the size of the connector is reduced. This is an important advantage in view of the high density requirements of present electronic systems.

Figure 4:
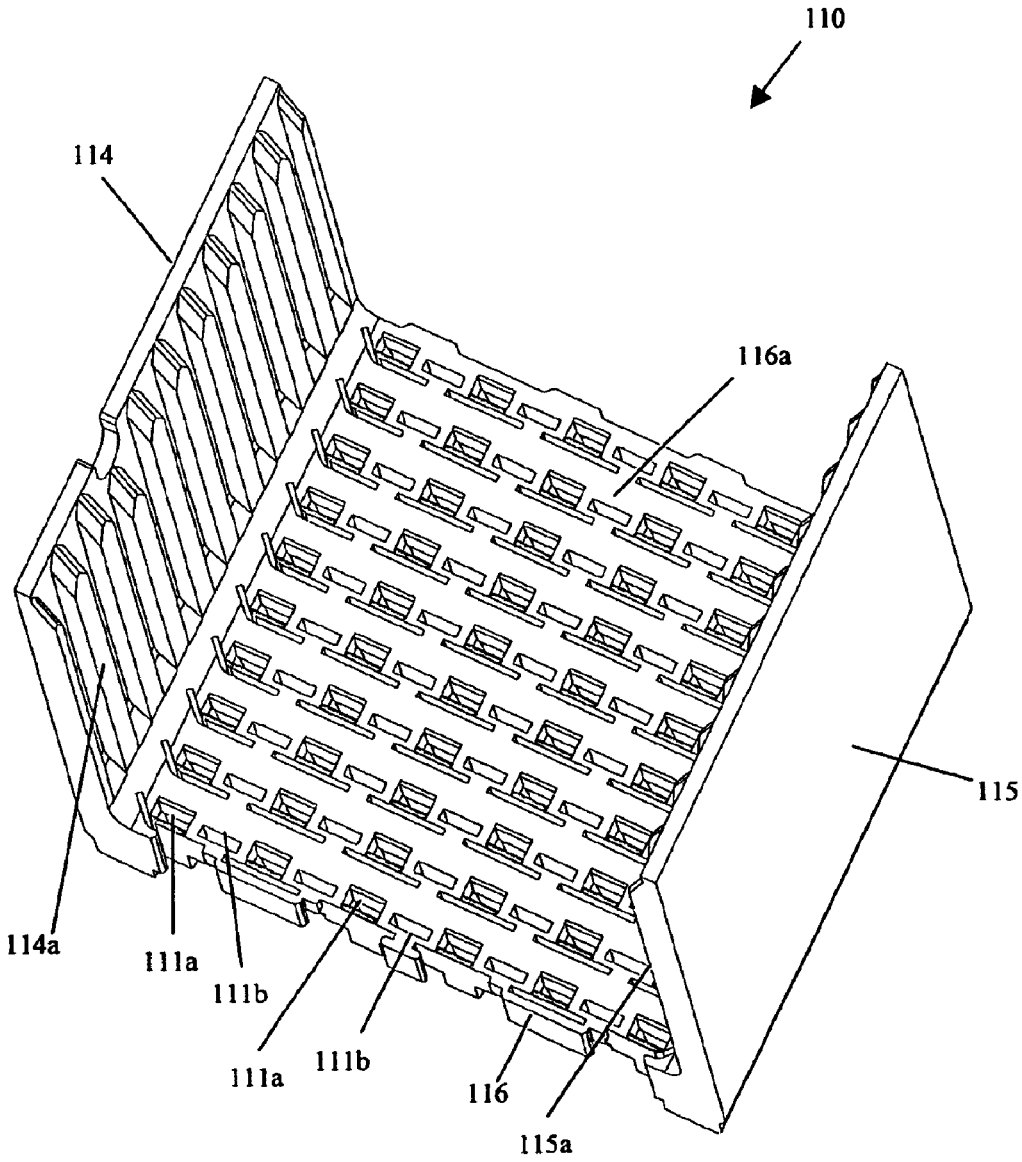
FIG. 4 is a perspective view of an insulative housing of the second electrical connector of FIG. 1.

Referring now to FIG. 4, there is shown a perspective view of an insulative housing 110 of the second electrical connector 100 of FIG. 1. The insulative housing 110 has a first side wall 114 with an inner surface 114*a*, a second side wall 115 with an inner surface 15*a*, and a base 116. The inner surfaces 114*a*, 115*a* of the first and second side walls 114, 115, respectively, define grooves for receiving the wafers 20 of the first electrical connector. While not shown in the preferred embodiment, outer surfaces of the first and second side walls 114, 115 may be provided with features to engage a stiffener. The use of such features provides modularity of design.

Figure 5:
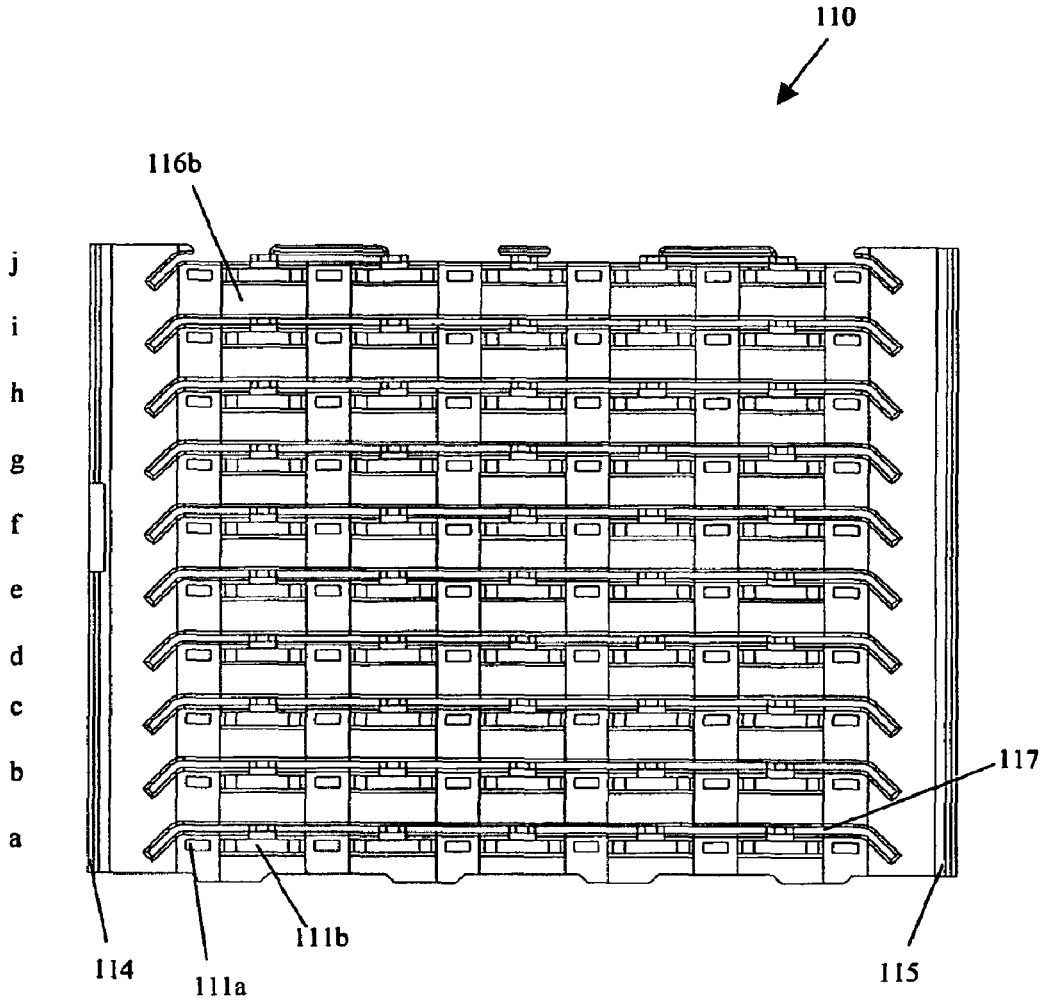
FIG. 5 is a bottom view of the insulative housing of FIG. 4.

The base 116 of the insulative housing 110 has a top surface 116*a* and a bottom surface 116*b* (see FIG. 5). The base 116 is provided with a plurality of openings 111*a*, 111*b* and a plurality of slots 117 in rows (rows a–j are referenced in FIG. 5). As will be described hereinafter, the openings 111*a* are configured to receive signal conductors 140, the openings 111*b* are configured to receive ground conductors 150, and the slots 117 are configured to receive ground strips 180 of the second electrical connector 100. Each row preferably has signal conductors 140 and ground conductors 150 positioned in an alternating manner. While the insulative housing 110 shown in FIGS. 1, 4 and 5 has ten grooves for receiving the wafers 20 and openings for receiving six signal conductors, the insulative housing may be designed to provide any number of grooves and openings as desired.

Figure 6A:
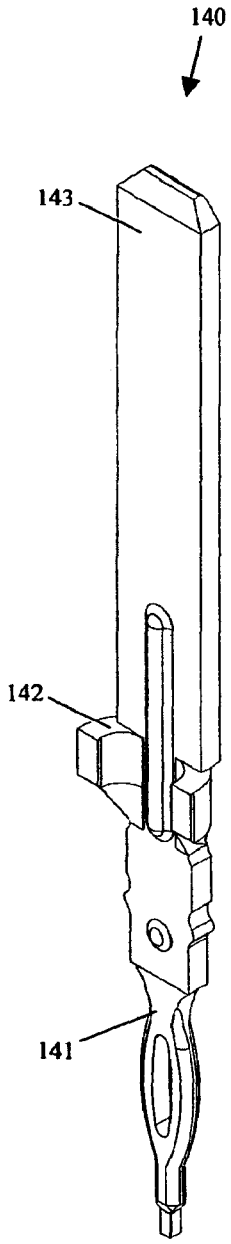
FIG. 6*a* is a perspective view of a signal conductor of the second electrical connector of FIG. 1.
Figure 6B:
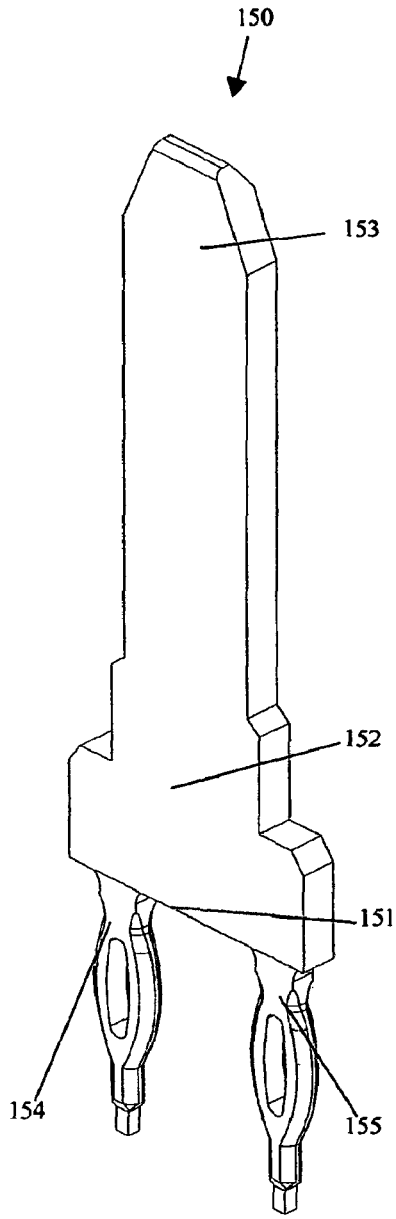
FIG. 6*b* is a perspective view of a ground conductor of the second electrical connector of FIG. 1.

Each signal conductor 140, as shown in FIG. 6*a*, has a first contact end 141 connectable to a printed circuit board, a second contact end 143 connectable to the second contact end 32 of the corresponding signal conductor 24 of the first electrical connector, and an intermediate portion 142 therebetween. Each ground conductor 150, as shown in FIG. 6*b*, has a first contact end 151 connectable to a printed circuit board, a second contact end 153 connectable to the second contact end 42 of the shield plate 26 of the first electrical connector, and an intermediate portion 152 therebetween.

In the preferred embodiment of the invention, the first contact end 141 of the signal conductors 140 is a press-fit contact tail. The second contact end 143 of the signal conductors 140 is configured as a blade to connect to the dual beam structure of the second contact end 32 of the corresponding signal conductors 24 of the first electrical connector. The first contact end 151 of the ground conductors 150 includes at least two press-fit contact tails 154, 155. The second contact end 153 of the ground conductors 150 is configured as a blade to connect to the opposing contacting members 45, 46 of the corresponding shield plate 26 of the first electrical connector. While the drawings show contact tails adapted for press-fit, it should be apparent to one of ordinary skill in the art that the first contact end 141 of the signal conductors 140 and the first contact end 151 of the ground conductors 150 may take any known form (e.g., pressure-mount contact tail, paste-in-hole solder attachment, contact pad adapted for soldering) for connecting to a printed circuit board.

The intermediate portion 142 of the signal conductors 140 and the intermediate portion 152 of the ground conductors 150 are disposed in the base 116 of the insulative housing 110. As presently considered by the inventors, the signal conductors 140 will be disposed into the openings 11*a* of the base 116 from the top while the ground conductors 150 will be disposed into the openings 111*b* of the base 116 from the bottom. Also, the ground strips 180 will be disposed into the slots 117 (see FIG. 5) of the base 116 from the bottom.

Figure 7:
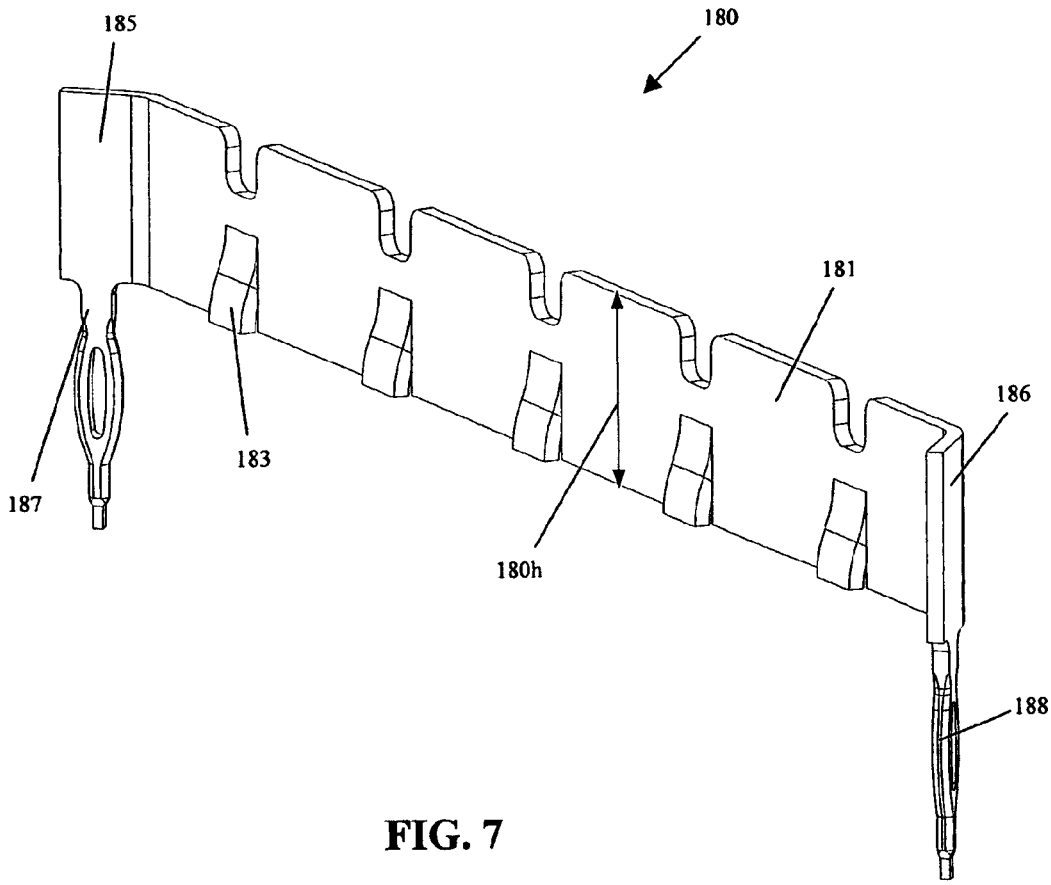
FIG. 7 is a perspective view of a ground strip of the second electrical connector of FIG. 1.

FIG. 7 shows one of the ground strips 180 in greater detail. For each row a–j of signal conductors 140 and ground conductors 150, one of the ground strips 180 is positioned adjacent thereto. The ground strip 180 includes a first surface 181 that faces the corresponding ground conductors 150 of the row, with the first surface 181 having projections 183 that electrically connect to the corresponding ground conductors 150 of the row when the second electrical connector 100 is assembled. The ground strip 180 also has a first end 185 and a second end 186, with the first and the second ends 185, 186 being bent in the direction of the corresponding row of signal conductors 140 and ground conductors 150. The first end 185 includes a contact tail 187 and the second end 186 includes a contact tail 188. Preferably, the contact tails 187, 188 are press-fit contact tails, although they may take any known form (e.g., pressure-mount contact tail, paste-in-hole solder attachment, contact pad adapted for soldering) for connecting to a printed circuit board.

Figure 8:
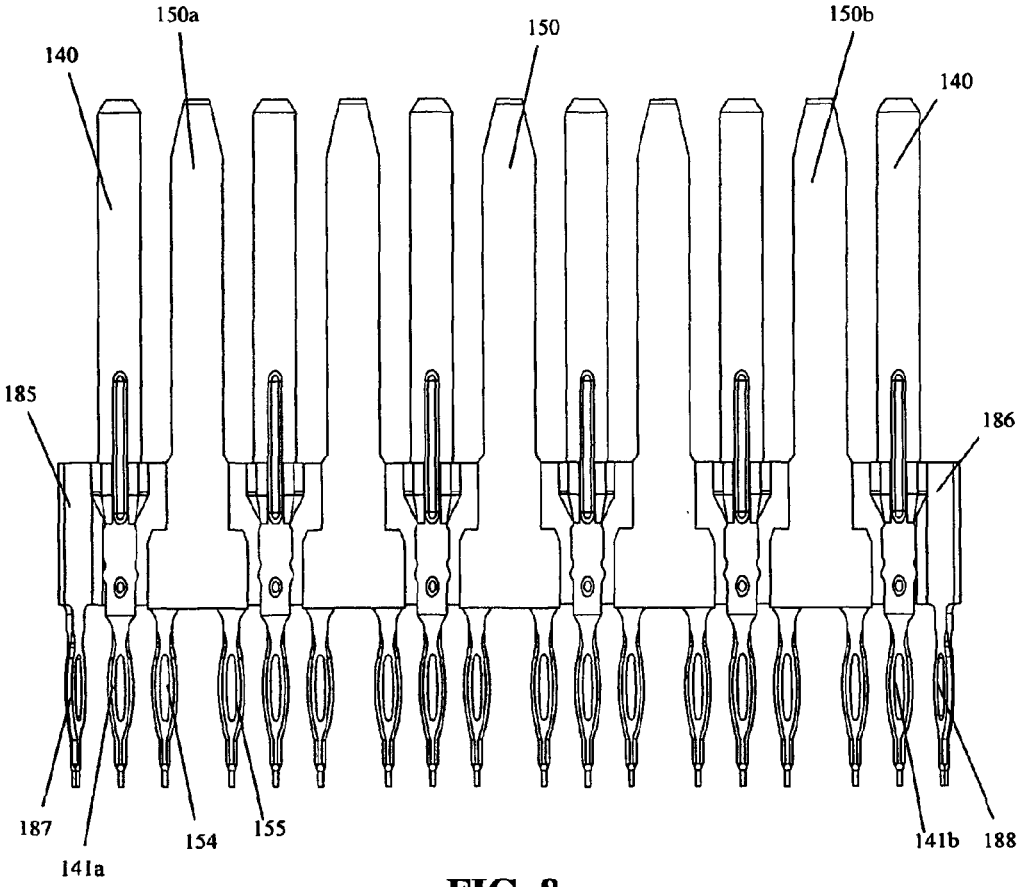
FIG. 8 is a front view of a row of signal conductors and ground conductors of FIGS. 6*a* and 6*b*, respectively, with a corresponding ground strip of FIG. 7.

As shown in FIG. 8, the first and second ends 185, 186 extend beyond the outermost first contact ends 141*a*, 141*b*, respectively, of the row of signal conductors 140. In the preferred embodiment, the first and second ends 185, 186 are bent at an angle that allows the contact tails 187, 188 to be aligned along a line with the contact tails 141, 154, 155 of the signal conductors 140 and the ground conductors 150 of the row, respectively, when connected to the printed circuit board. Also, as apparent from FIGS. 4 and 5, a distance between a signal conductor contact tail 141 and an adjacent ground conductor contact tail 154, 155, 187, 188 of a row is less than a distance between adjacent rows. Furthermore, for each of the rows, a distance between a signal conductor contact tail and an adjacent ground conductor contact tail on one side is preferably similar to a distance between the signal conductor contact tail and an adjacent ground conductor contact tail on the other side. By these design details, desirable shielding (and thus, improved signal electrical characteristics) is provided to the signal conductors of the electrical connector assembly 10.

Note that the base 116 of the insulative housing 110 has a first height 116*h* (see FIG. 1) and the ground strip 180 has a second height 180*h* (see FIG. 7). In the preferred embodiment, the second height 180*h* of the ground strip 180 is not greater than the first height 116*h* of the base 116 of the insulative housing 110. The purpose of the ground strip 180 is primarily to lessen the cross-talk present in the base 116 of the insulative housing 110 between adjacent rows of signal conductors 140. Thus, while the ground strip 180 is not required for the operation of the electrical connector assembly of the present invention, its disposition in the base 116 to substantially shield the entire height 116*h* of the base 116 is preferred.

Figure 9:
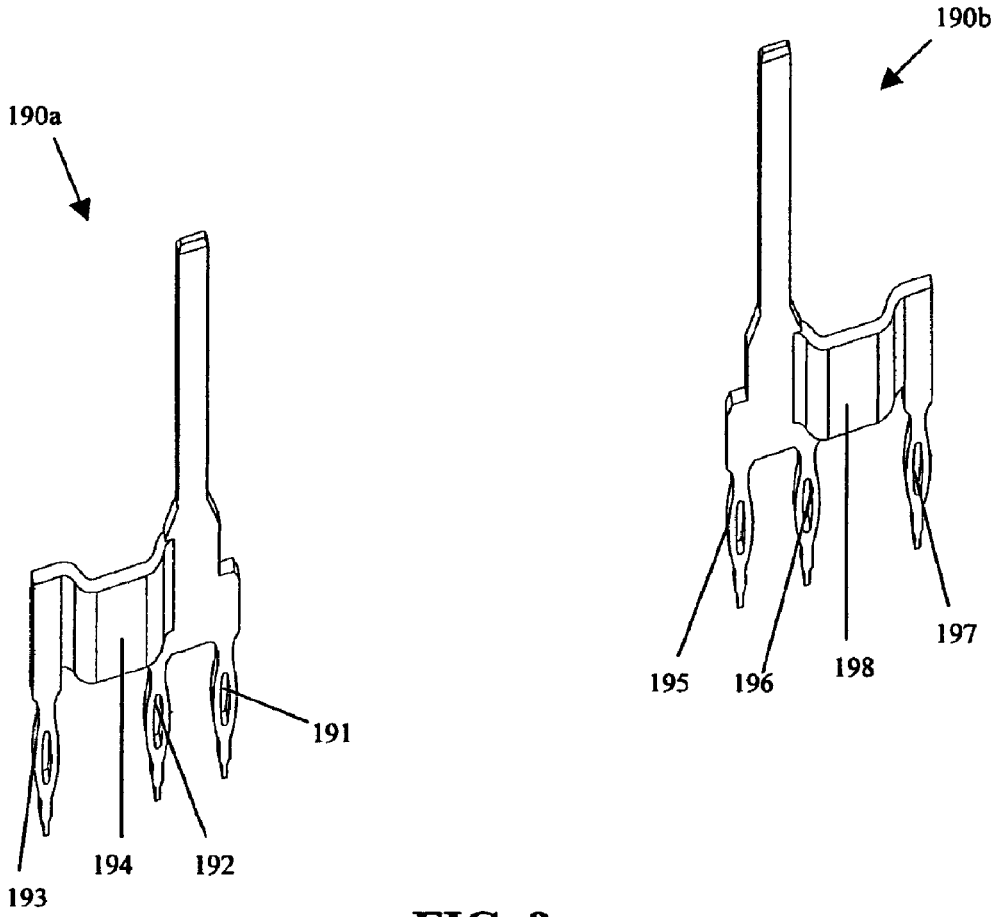
FIG. 9 is a perspective view of an alternative embodiment of outer ground conductors suitable for the second electrical connector of FIG. 1.

Referring now to FIG. 9, there is shown a perspective view of an alternative embodiment of outer ground conductors 190*a*, 190*b* suitable for the second electrical connector 100 of FIG. 1. Ground conductor 190*a* would replace ground conductor 150*a* of FIG. 8, and ground conductor 190*b* would replace ground conductor 150*b*. Corresponding ground strip 180 is not required; however, if used, then contact tails 187, 188 will not be necessary. The ground conductor 190*a* includes three contact tails 191, 192, 193. An extending arm 194 connects contact tails 192, 193. The extending arm 194 is configured to provide sufficient space to accommodate an outermost signal conductor 140 of the row. Likewise, the ground conductor 190*b* includes three contact tails 195, 196, 197. An extending arm 198 connects contact tails 196, 197. The extending arm 198 is configured to provide sufficient space to accommodate the other outermost signal conductor 140 of the row.

For exemplary purposes only, the insulative housing 110 of the second electrical connector 100 is illustrated to receive ten rows of signal conductors 140 and ground conductors 150 disposed therein. Each row has six signal conductors 140. These ten rows with each row having six signal conductors 140 correspond to the ten wafers 20 of the first electrical connector, with each wafer 20 having six signal conductors 24. It should be apparent to one of ordinary skill in the art that the number of wafers 20, the number of signal conductors 24, and the number of signal conductors 140 and ground conductors 150 may be varied as desired.

Figure 10:
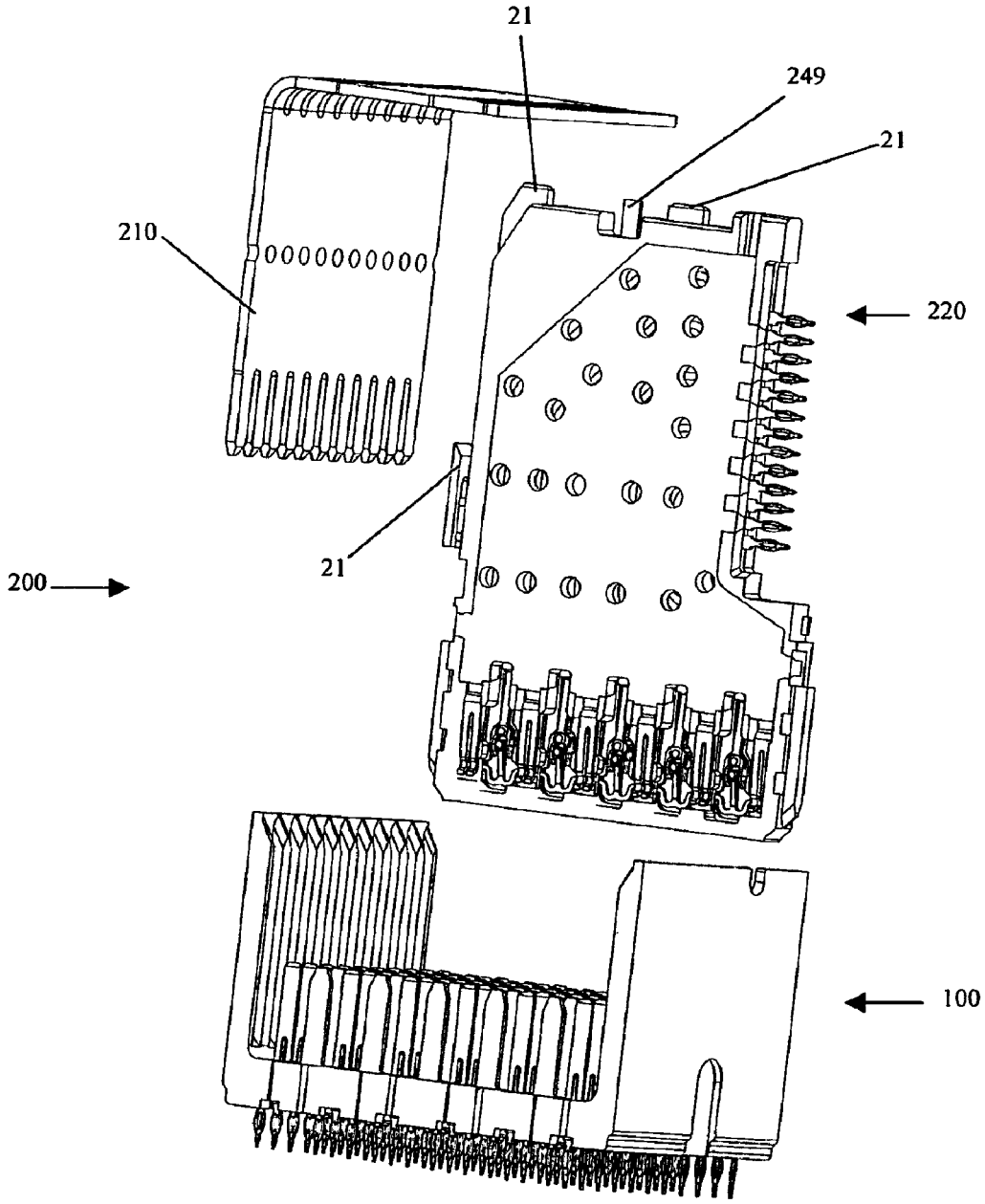
FIG. 10 is a perspective view of another embodiment of the electrical connector assembly of the present invention showing one of the wafers of a first electrical connector about to mate with a second electrical connector.

Referring now to FIG. 10, there is shown an alternative embodiment of an electrical connector assembly of the present invention. The electrical connector assembly 200 includes a first electrical connector mateable to a second electrical connector. Preferably, the second electrical connector is the same as the second electrical connector 100 in FIG. 1. However, other electrical connectors may be used in place of the second electrical connector 100. For example, an electrical connector without the ground strip 180 (see FIG. 7) or a ground conductor 150 having two contact tails 154, 155 (see FIG. 6*b*) may be utilized.

The first electrical connector includes a plurality of wafers 220, only one of which is shown in FIG. 10, with the plurality of wafers 220 preferably held together by a conductive stiffener 210. The main difference between the wafer 20 in FIG. 1 and the wafer 220 in FIG. 10 is that tab member 249 of the shield plate for wafer 220 is longer than tab member 49 of the shield plate 26 for wafer 20 (FIG. 3). Preferably, all other aspects of wafer 220 are similar to that of wafer 20.

By making the tab member 249 longer than the tab member 49, the tab member 249 is exposed when the insulative housing is formed around the signal conductors and the shield plate by a molding process. As the conductive stiffener 210 engages the attachment features 21 of the insulative housing, it makes an electrical connection to the shield plate via the exposed tab member 249.

What is the benefit of electrically connecting the shield plates of the wafers 220 of the first electrical connector? Resonant frequency can degrade the signal transmission characteristics of a connector. By electrically connecting the shield plates, this has the effect of increasing the resonant frequency of the ground structure of the connector assembly beyond the significant operational frequency range of the connector assembly. In this manner, degradation of signal transmission characteristics can be reduced. For example, test data have shown that by electrically connecting the shield plates, there is a 2 decibel improvement at an operating frequency of 3 GHz.

While electrically connecting the shield plates provides desired results, it should be noted that any electrical connection of the ground structures at a voltage maximum will achieve desirable results as well.

Figure 11:
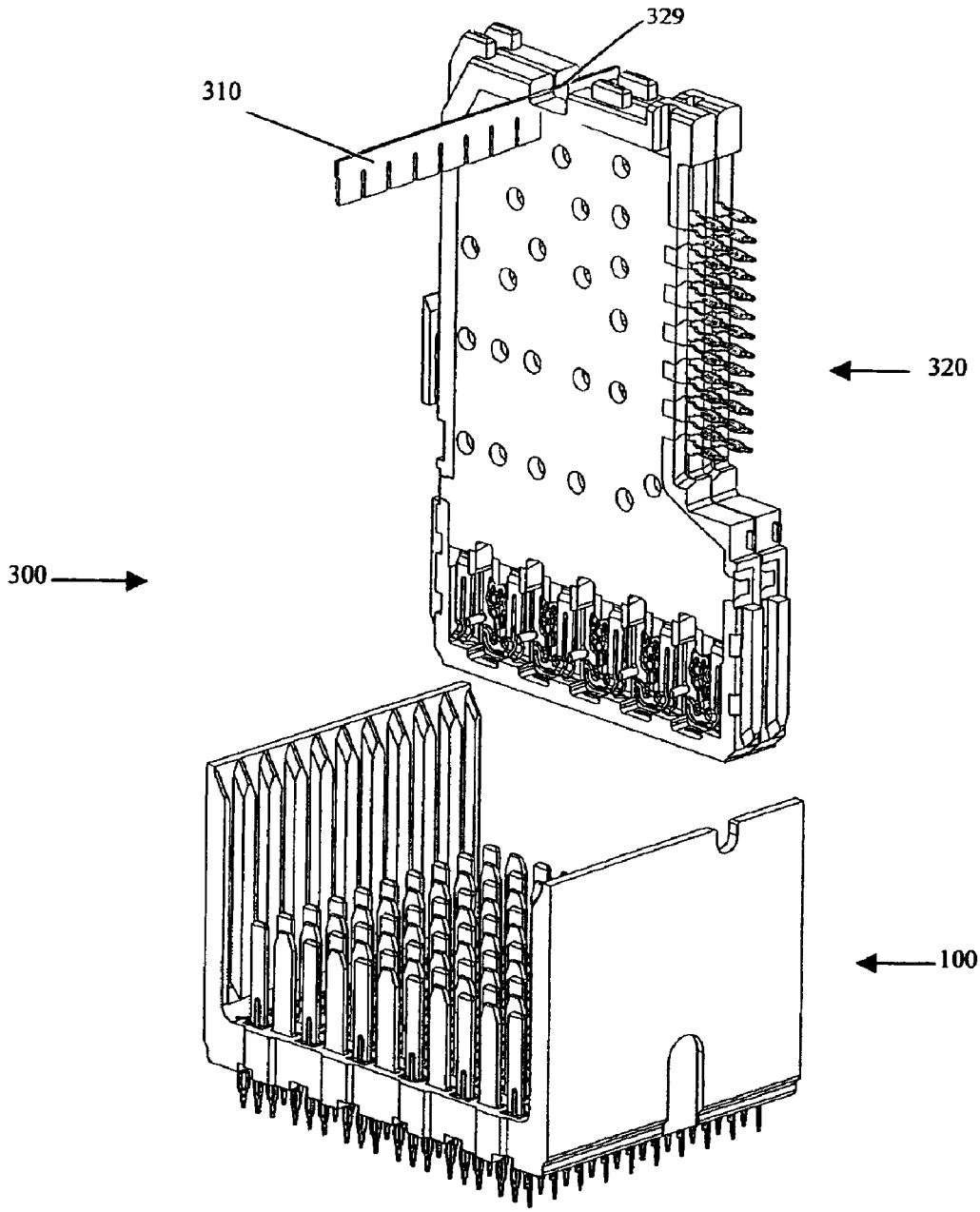
FIG. 11 is a perspective view of still another embodiment of the electrical connector assembly of the present invention showing two of the wafers of a first electrical connector about to mate with a second electrical connector.

Referring now to FIG. 11, there is shown still another alternative embodiment of an electrical connector assembly of the present invention. The electrical connector assembly 300 includes a first electrical connector mateable to a second electrical connector. Preferably, the second electrical connector is the same as the second electrical connector 100 in FIG. 1. However, other electrical connectors may be used in place of the second electrical connector 100. For example, an electrical connector without the ground strip 180 (see FIG. 7) or a ground conductor 150 having two contact tails 154, 155 (see FIG. 6*b*) may be utilized.

The first electrical connector includes a plurality of wafers 320, only two of which are shown in FIG. 11, with the plurality of wafers 320 preferably held together by a stiffener, such as the stiffener 210 of FIG. 10. The main difference between the wafer 20 in FIG. 1 and the wafer 320 in FIG. 11 is that for wafer 320, there is an area 329 provided by the insulative housing which exposes a portion of the intermediate portion 41 of the shield plate 26. For wafer 20, the corresponding area 29 (see FIG. 1) does not expose a portion of the intermediate portion 41 of the shield plate 26. Note that the exposed portion of the intermediate portion 41 may be the tab member 49 (see FIG. 3). The area 329 is preferably formed during the molding process. Preferably, all other aspects of wafer 320 are similar to that of wafer 20.

A conductive member 310 electrically connects the shield plate of each wafer 320 at the area 329. As with the embodiment of FIG. 10, this has the effect of increasing the resonant frequency of the ground structure of the connector assembly beyond the significant operational frequency range of the connector assembly.

Having described the preferred and alternative embodiments of the invention, it will now become apparent to one of ordinary skill in the art that other embodiments incorporating their concepts may be used. For example, while the drawings show a shield plate, other forms of shield structures may also be used, such as individual shield strips with each shield strip corresponding to a signal conductor. Also, while the drawings show single-ended signals, differential signals may also be used with the present invention.

It is felt therefore that these embodiments should not be limited to disclosed embodiments but rather should be limited only by the spirit and scope of the appended claims.

All publications and references cited herein are expressly incorporated herein by reference in their entirety.

What is claimed is:

1. An electrical connector assembly having a first electrical connector mateable to a second electrical connector, the electrical connector assembly comprising:

the first electrical connector comprising a plurality of wafers, with each of the plurality of wafers including:

a first insulative housing;

a plurality of first signal conductors, with each first signal conductor having a first contact end connectable to a first printed circuit board, a second contact end, and an intermediate portion therebetween that is disposed in the first insulative housing;

a shield plate, the shield plate having a plurality of first contact ends connectable to the first printed circuit board, a plurality of second contact ends, and an intermediate portion therebetween that is disposed in the first insulative housing;

the second electrical connector comprising:

second insulative housing including side walls and a base;

a plurality of second signal conductors, with each second signal conductor having a first contact end connectable to a second printed circuit board, a second contact end mateable to the second contact end of one of the first signal conductors, and an intermediate portion therebetween that is disposed in the base of the second insulative housing;

a plurality of ground conductors, with each ground conductor having first contact end connectable to the second printed circuit board, a second contact end mateable to the second contact end of the shield plate, and an intermediate portion therebetween that is disposed in the base of the second insulative housing;

the second signal conductor and the ground conductors are arranged in a plurality of rows, with each row having second signal conductors and ground conductors;

for each of the plurality of rows, there is a corresponding ground strip positioned adjacent thereto disposed in the base of the insulative housing, where the ground strip is electrically connected to the ground conductors of the row; and the ground strip has a first end and a second end, the first and and the second end being bent in the direction of the corresponding row of second signal conductors and ground conductors, and the first end of the ground strip extending beyond an end of the row and the second end of the group strip extending beyond the other end of the row.

2. The electrical connector assembly of claim 1, wherein the first end of the ground strip includes a contact tail connectable to the second printed circuit board and the second end of the ground strip includes a contact tail connectable to the second printed circuit board.

3. The electrical connector assembly of claim 2, wherein for each of the plurality of rows, the first contact ends of the second signal conductors and the ground conductors and the contact tails of the corresponding ground strip are aligned along a line when connected to the second printed circuit board.

4. The electrical connector assembly of claim 3, wherein for each of the plurality of rows, the first contact end of each second signal conductor comprises a contact tail and the first contact end of each ground conductor comprises at least two contact tails so that for each second signal conductor contact tail, there are ground conductor contact tails adjacent either side of the second signal conductor contact tail.

5. An electrical connector assembly having a first electrical connector mateable to a second electrical connector, the electrical connector assembly comprising:

the first electrical connector comprising a plurality of wafers, with each of the plurality of wafers including:

a first insulative housing;

a plurality of first signal conductors, with each first signal conductor having a first contact end connectable to a first printed circuit board, a second contact end, and an intermediate portion therebetween that is disposed in the first insulative housing;

at least one shield plate, the shield plate having at least one first contact end connectable to the first printed circuit board, at least one second contact end, and an intermediate portion therebetween that is disposed in the first insulative housing;

the shield plate also having first and second edges adjacent the second contact end, the first and second edges being bent in the direction of the first signal conductors of the wafer;

the first insulative housing providing an area which exposes a portion of the intermediate portion of the shield plate;

a conductive member attached to the plurality of wafers, the conductive member electrically connecting to each shield plate at the exposed intermediate portion of the shield plate;

the second electrical connector having a second insulative housing and ground conductors and second signal conductors in a plurality of rows, with each of the plurality of rows comprising:

a plurality of ground conductors and second signal conductors;

each second signal conductor having a first contact end connectable to a second printed circuit board, a second contact end mateable to the second contact end of one of the first signal conductors, and an intermediate portion therebetween that is disposed in the second insulative housing;

each ground conductor having a first contact end connectable to the second printed circuit board, a second contact end mateable to the second contact end of the shield plate, and an intermediate portion therebetween that is disposed in the second insulative housing;

the first contact end of the second signal conductor having a contact tail and the first contact end of the ground conductor having at least one contact tail; and the second signal conductors and the ground conductors are positioned adjacent to one another so that for each second signal conductor contact tail, there are ground conductor contact tails adjacent either side of the second signal conductor contact tail.

6. The electrical connector assembly of claim 5, wherein the shield plate further includes a first plurality of the first contact ends connectable to the first printed circuit board and a second plurality of the second contact ends, the first plurality being greater in number than the second plurality.

7. An electrical connector assembly having a first electrical connector mateable to a second electrical connector, the electrical connector assembly comprising:

the first electrical connector comprising a plurality of wafers, wit each of the plurality of wafers including:

a first insulative housing, the first insulative housing having an attachment feature;

a plurality of first signal conductors, with each first signal conductor having a first contact end connectable to a first printed circuit board, a second contact end, and an intermediate portion therebetween that is disposed in the first insulative housing;

at least one ground member, the ground member having at least one first contact end connectable to the first printed circuit board, at least one second contact end, and an intermediate portion therebetween that is disposed in the first insulative housing;

the intermediate portion of the ground member having at least one tab member, at least a portion of the tab member being exposed when the intermediate portion of the ground member is disposed in the first insulative housing;

a conductive stiffener attached to the plurality of wafers through the attachment feature of the first insulative housing, the conductive stiffener electrically connecting to each ground member at the tab member, the second electrical connector having a second insulative housing and ground conductors and second signal conductors in a plurality of rows, with each of the plurality of rows comprising:

a plurality of ground conductors and second signal conductors;

each second signal conductor having a first contact end connectable to a second printed circuit board, a second contact end mateable to the second contact end of one of the first signal conductors, and an intermediate portion therebetween that is disposed in the second insulative housing;

each ground conductor having a firm contact end connectable to the second printed circuit board, a second contact end mateable to the second contact end of the ground member, and an intermediate portion therebetween that is disposed in the second insulative housing;

the first contact end of the second signal conductor having a contact tail and the first contact and of the ground conductor having at least one contact tail; and the second signal conductors and the ground conductors are positioned adjacent to one another so that for each second signal conductor contact tail, there are ground conductor contact tails adjacent either side of the second signal conductor contact tail.

* * * * *